US009951783B2

(12) United States Patent
Hasegawa et al.

(10) Patent No.: US 9,951,783 B2
(45) Date of Patent: Apr. 24, 2018

(54) CENTRIFUGAL COMPRESSOR

(71) Applicant: MITSUBISHI HEAVY INDUSTRIES, LTD., Tokyo (JP)

(72) Inventors: Osamu Hasegawa, Tokyo (JP); Yasushi Hasegawa, Tokyo (JP); Shintaro Omura, Tokyo (JP); Kenji Ueda, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 395 days.

(21) Appl. No.: 14/442,028

(22) PCT Filed: Nov. 14, 2013

(86) PCT No.: PCT/JP2013/080771
§ 371 (c)(1),
(2) Date: May 11, 2015

(87) PCT Pub. No.: WO2014/077310
PCT Pub. Date: May 22, 2014

(65) Prior Publication Data

US 2015/0322965 A1 Nov. 12, 2015

(30) Foreign Application Priority Data

Nov. 15, 2012 (JP) ..... 2012-251177
Feb. 27, 2013 (JP) ..... 2013-037524

(51) Int. Cl.
*F04D 25/02* (2006.01)
*F04D 29/42* (2006.01)
(Continued)

(52) U.S. Cl.
CPC ..... *F04D 25/02* (2013.01); *F04D 17/122* (2013.01); *F04D 25/06* (2013.01);
(Continued)

(58) Field of Classification Search
CPC .... F04D 29/46; F04D 29/462; F04D 29/4213; F04D 29/56; F04D 29/563; F01D 17/162
See application file for complete search history.

(56) References Cited

U.S. PATENT DOCUMENTS 3,645,144 A 2/1972 Barrows, Jr.
3,781,127 A 12/1973 Wood
(Continued)

FOREIGN PATENT DOCUMENTS

CN 101571138 A 11/2009
JP 46-7852 B 2/1971
(Continued)

OTHER PUBLICATIONS

Chinese Office Action and Search Report dated May 5, 2016, for Chinese Application No. 201380058799.3 with the English translation.
(Continued)

*Primary Examiner* — Kenneth Bomberg
*Assistant Examiner* — Hoon Choi
(74) *Attorney, Agent, or Firm* — Birch, Stewart, Kolasch & Birch, LLP

(57) ABSTRACT

This centrifugal compressor is provided with an impeller mounted on a main shaft rotating around an axis line, and a vane device for adjusting the flow rate of a fluid in an inflow flow path to the impeller. The vane device includes: a plurality of vane main bodies provided at intervals in a circumferential direction, wherein a mounting angle of the plurality of vane main bodies is changed by rotating the shaft portion; a plurality of link members which is rotated along with the shaft portion; a drive ring which is formed with an annular shape centered on the axis line and is moved in a moving direction along a rotation locus of the link member, and a drive mechanism which is connected to the drive ring
(Continued)

and transmits a force in a tangential direction to the drive ring.

5 Claims, 10 Drawing Sheets

(51) Int. Cl.
*F04D 25/06* (2006.01)
*F04D 29/46* (2006.01)
*F04D 17/12* (2006.01)

(52) U.S. Cl.
CPC ..... *F04D 29/4206* (2013.01); *F04D 29/4213* (2013.01); *F04D 29/462* (2013.01); *F05D 2250/51* (2013.01)

(56) References Cited

U.S. PATENT DOCUMENTS

| | | | | |
|---|---|---|---|---|
| 4,521,002 | A * | 6/1985 | Adorjan | B60G 15/063 267/170 |
| 4,726,744 | A | 2/1988 | Arnold | |
| 4,890,977 | A | 1/1990 | Tremaine et al. | |
| 5,096,374 | A * | 3/1992 | Sakai | F01D 17/162 384/206 |
| 6,398,483 | B1 * | 6/2002 | Conete | F01D 17/162 415/130 |
| 2009/0180858 | A1 | 7/2009 | Tapper | |
| 2010/0172745 | A1 | 7/2010 | Hodder | |

FOREIGN PATENT DOCUMENTS

| | | | | |
|---|---|---|---|---|
| JP | 47-1182 | A | 1/1972 | |
| JP | 47-33524 | U | 12/1972 | |
| JP | 49-57406 | A | 6/1974 | |
| JP | 50-147903 | U | 12/1975 | |
| JP | 53-113407 | U | 9/1978 | |
| JP | 54-711 | U | 1/1979 | |
| JP | 55-67398 | U | 5/1980 | |
| JP | 55-137299 | U | 9/1980 | |
| JP | 56-39896 | U | 4/1981 | |
| JP | 56-41465 | A | 4/1981 | |
| JP | 56-143533 | U | 10/1981 | |
| JP | 58-205000 | A | 11/1983 | |
| JP | 59-88297 | U | 6/1984 | |
| JP | 59-160895 | U | 10/1984 | |
| JP | 62-34197 | U | 2/1987 | |
| JP | 63-43438 | Y2 | 11/1988 | |
| JP | 4-358798 | A | 12/1992 | |
| JP | 5-83399 | U | 11/1993 | |
| JP | 2001-107888 | A | 4/2001 | |
| JP | 2001-200799 | A | 7/2001 | |
| JP | 2003-214380 | A | 7/2003 | |
| JP | 2006-46220 | A | 2/2006 | |
| JP | 2007-517159 | A | 6/2007 | |
| JP | 2007-298044 | A | 11/2007 | |
| JP | 4107772 | B2 | 6/2008 | |
| JP | 4107772 | B2 * | 6/2008 | F04D 17/122 |
| JP | 2008-163803 | A | 7/2008 | |
| JP | 4166996 | B2 | 10/2008 | |
| JP | 2010-48160 | A | 3/2010 | |
| JP | 2011-80401 | A | 4/2011 | |

OTHER PUBLICATIONS

International Search Report, dated Jan. 21, 2014, for International Application No. PCT/JP2013/080771, with an English translation.
Written Opinion of the International Searching Authority, dated Jan. 21, 2014, for Application No. PCT/JP2013/080771, with an English translation.
Singapore Search Report and Written Opinion, dated Feb. 11, 2016, for Singapore Application No. 11201503703R.

* cited by examiner

CENTRIFUGAL COMPRESSOR

TECHNICAL FIELD

The present invention relates to an inlet guide vane which is provided in a centrifugal compressor.

Priorities are claimed on Japanese Patent Application No. 2012-251177, filed Nov. 15, 2012, and Japanese Patent Application No. 2013-37524, filed Feb. 27, 2013, the contents of which are incorporated herein by reference.

BACKGROUND ART

In a centrifugal compressor in, for example, a turbo refrigerator or a turbocharger, an inlet guide vane (hereinafter referred to as an IGV) which has a plurality of blades and performs flow rate adjustment is provided. Specifically, in the IGV, flow rate adjustment is performed by adjusting the degree of opening of an inflow flow path of a working fluid by rotating the blades.

Here, Patent Document 1 discloses a vane drive device which is a drive mechanism of an IGV. The drive device performs the adjustment of the degree of opening by rotationally driving each vane by rotating a driven pinion gear provided at a shaft of each vane, through a bevel gear provided annularly by a main drive pinion gear provided in an electric motor.

Further, in a centrifugal compressor of Patent Document 2, the adjustment of the degree of opening is performed by rotating an annular member provided on a concentric axis with a rotary shaft on the outer periphery side of an inflow nozzle section, through a connecting link, thereby rotationally driving each vane supported on the annular member.

PRIOR ART DOCUMENT

Patent Document

[Patent Document 1] Japanese Unexamined Patent Application, First Publication No. 2006-46220

[Patent Document 2] Japanese Patent No. 4107772

SUMMARY OF INVENTION

Technical Problem

However, the drive mechanism described in Patent Document 1 has a gear drive configuration, and therefore, for example, if a compressor is increased in size, the bevel gear provided annularly is also increased in size, and thus the manufacturing cost is greatly increased. Further, in order to smoothly perform gear drive, a backlash is required, and therefore, there is also a possibility that an error in the degree of opening of the vane may occur or vibration may occur in the vane.

Further, in a drive mechanism of Patent Document 2, although there is no detailed description, it is not a mechanism of actively moving the annular member in a direction of an axis line, and therefore, in order to rotationally drive the vane by rotating the annular member, it is necessary to provide a large backlash in a hole portion of the annular member which is engaged with a connecting member provided at each vane with a spherical surface pair. Therefore, the degree of accuracy of the degree of opening of the vane is reduced due to the backlash, and thus an operation of the compressor in the optimum conditions becomes difficult.

The present invention provides a centrifugal compressor in which it is possible to reduce cost and accurately adjust a flow rate.

Technical Solution

According to a first aspect of the present invention, there is provided a centrifugal compressor including: a main shaft which rotates around an axis line; a bladed wheel mounted on the main shaft; and a vane device which adjusts a flow rate of a fluid in an inflow flow path to the bladed wheel. The vane device includes a plurality of vane main bodies provided at intervals in a circumferential direction with respect to the axis line of the main shaft in the inflow flow path and each of rotary shaft extending in a radial direction with respect to the axis line of the main shaft, wherein a mounting angle of the plurality of vane main bodies is changed by rotating the rotary shaft, a plurality of link members which is rotated along with the rotary shaft, wherein, a first end of the plurality of link members is connected to each of the rotary shaft, an annular member which is formed with an annular shape centered on the axis line and is moved in a moving direction along a rotation locus of the link member, wherein the moving direction is both a axial direction and the circumferential direction, the rotation locus is generated by rotating with the vane main body, and the annular member is connected to a second end of the plurality of link members, and a drive mechanism which is connected to the annular member and transmits a force in a tangential direction to the annular member.

According to such a centrifugal compressor, the vane device is provided, whereby a force is applied to the annular member in the tangential direction by the drive mechanism, and thus the annular member rotates about the axis line, and accordingly, the plurality of link members rotate around each rotary shaft along with the rotary shaft. If the link members rotate, the annular member moves so as to be pulled or pushed in the axial direction due to the link members. Then, at the same time, each vane main body rotates, and thus a mounting angle is changed, whereby flow rate adjustment becomes possible.

Here, for example, in the fully closed state of the vane device where the flow rate of the fluid becomes zero, the vane main body is pressed in the axial direction due to a difference in pressure between the suction side and the discharge side, and thus a large force is sometimes required for an opening and closing operation. According to the first aspect of the present invention, even in such a case, since a force in the circumferential direction is directly applied to the annular member by the drive mechanism, a rotational force around the rotary shaft is uniformly applied to all of the link members. Therefore, it is possible to smoothly adjust a mounting angle of the vane main body, and thus it becomes possible to reduce the power of a driving source of the drive mechanism. Further, the start-up of the compressor from the fully closed state of the vane device becomes possible, whereby start-up in a substantially vacuum state becomes possible, and thus power at the time of start-up when most of the load is applied is also reduced. For this reason, a main electric motor which is a driving source of the compressor can also be reduced in size, thereby leading to a reduction in the size of the entire apparatus. Further, as for the drive mechanism, since it is acceptable if it has a configuration of applying a rotational force to the annular member, it is not necessary to use a complicated mechanism.

In addition, in the annular member, in addition to the movement in the circumferential direction, the movement in the axial direction is also possible. That is, a structure is made in which a backlash is not provided in the axial direction according to the rotational motion of the link member in advance, but an operation in the axial direction is actively allowed. Therefore, the degree of accuracy of the adjustment of the degree of opening of a vane is not reduced.

According to a second aspect of the present invention, the drive mechanism may have an electric motor provided with an output shaft which is rotationally driven, and a transmission arm transmitting a rotational force of the electric motor as a force in the tangential direction, wherein the a first end of the transmission arm is connected to the output shaft, and the second end of the transmission arm is connected to the annular member.

In this manner, by adopting the electric motor and the transmission arm for the drive mechanism, it is possible to apply a force to the annular member with a simple configuration, and thus it becomes possible to adjust the angle of the vane main body by rotating the annular member, while reducing cost.

According to a third aspect of the present invention, the transmission arm may have a driving lever which is fixed to the output shaft, extends in a radial direction of the output shaft, and rotates along with the output shaft, and a driving link bar, wherein a first end of the driving link bar is connected to the driving lever, and a second end of the driving link bar is connected to the annular member, and the driving link bar may be provided with a connecting rod-shaped portion extending along the circumferential direction with respect to the axis line of the main shaft, and universal joints provided at both ends of the connecting rod-shaped portion, and a first end of the transmission arm is connected to the driving lever via the universal joint, a second end of the transmission arm is connected to the annular member via the universal joint.

In this manner, the driving lever and the annular member are connected through the universal joints, whereby when the rotational force of the electric motor is transmitted to the annular member by the transmission arm, the transmission arm can be smoothly operated three-dimensionally. Therefore, even in a state where the annular member moves in the axial direction in accordance with the movement in the circumferential direction, it becomes possible to reliably transmit a force from the electric motor to the annular member without interfering with the operation. Therefore, it becomes possible to more accurately adjust the flow rate.

According to a fourth aspect of the present invention, the universal joints may include two spherical bearings which are connected to the driving lever and the annular member, and rod-shaped portions extending toward the connecting rod-shaped portion from the respective spherical bearings, thereby coming into contact with the connecting rod-shaped portion, and having a first threaded portion provided in a portion which is brought into contact with the connecting rod-shaped portion, and the connecting rod-shaped portion may be provided with a second threaded portion which is screw with the first threaded portion.

Due to such a universal joint, when mounting the universal joint on the connecting rod-shaped portion, the first threaded portion and the second threaded portion are fastened to each other in a state where the rod-shaped portion is brought into contact with the connecting rod-shaped portion, whereby the total length dimension that is the sum of the length of the connecting rod-shaped portion and the length of the universal joint, that is, the length dimension of the driving link bar, can always be the same dimension irrespective of which worker performs fastening work. Therefore, work required for the length adjustment of the transmission arm becomes unnecessary, thereby leading to an improvement in workability.

According to a fifth aspect of the present invention, the transmission arm may have a driving lever which is fixed to the output shaft, extends in a radial direction of the output shaft, and rotates along with the output shaft, and a driving link member, wherein a first end of the driving link member is connected to the driving lever, and a second end of the driving link member is connected to the annular member, and the driving link member may be provided with a connection portion extending in a direction away from the annular member, and two universal joints provided at the connection portion so as to be spaced apart from each other in at least one of the axial direction and a radial direction with respect to the axis line of the main shaft, and a first end of the transmission arm may be connected to the driving lever via the universal joint on one side, and a second end of the transmission arm may be connected to the annular member through the universal joint on the other side, In this manner, the two universal joints are connected to be offset in at least one of the axial direction and the radial direction with respect to the axis line of the main shaft by the connection portion, whereby even if the installation position of the electric motor is spaced apart from the annular member in the axial direction or the radial direction, it is possible to reliably operate the annular member by the transmission arm.

According to a sixth aspect of the present invention, the transmission arm may have a driving lever which is fixed to the output shaft, extends in a radial direction of the output shaft, and rotates along with the output shaft, and a driving link member, wherein a first end of the driving link member is connected to the driving lever, and a second end of the driving link member is connected to the annular member, and the driving link member may be provided with a damping member which is damping a force acting on the driving link member, and is provided between the first end of the driving link member and the second end of the driving link member, and two universal joints provided at the damping member, and a first end of the transmission arm may be connected to the driving lever via the universal joint on one side, and a second end of the transmission arm may be connected to the annular member via the universal joint on the other side, In this manner, the damping member is provided in the transmission arm, whereby it also becomes possible to suppress a vibration phenomenon such as self-excited vibration by the fluid which flows in, and therefore, it is possible to prevent wear or deterioration of components of the centrifugal compressor, and thus it becomes possible to prolong a product life.

According to a seventh aspect of the present invention, the centrifugal compressor may further include: a torque detection section which detects torque of the electric motor; and a control section which reversely rotates the output shaft of the electric motor in a case where a detected value in the torque detection section exceeds a threshold value set in advance.

In a case where the annular member does not operate to one side in the circumferential direction due to some cause, the torque of the electric motor is increased, as compared to that at the time of a normal operation. Here, by detecting the torque in the torque detection section and reversely rotating the electric motor by the control section, thereby operating the annular member to the other side in the circumferential direction with respect to the axis line of the main shaft on one occasion, it becomes possible to return the annular member to a normal operation state, and thus the angle adjustment of the vane main body becomes possible.

According to an eighth aspect of the present invention, the vane main body may have a torque limiter section which allows the rotary shaft to perform relative rotation between the rotary shaft and the link member in a case where torque acting on the vane main body exceeds a threshold value set in advance.

In a case where one vane main body does not rotate due to some cause, the link member connected to the vane main body does not operate, and thus the annular member does not operate.

For this reason, all of the vane main bodies do not operate, and thus the flow rate adjustment of the fluid which flows in the inflow flow path becomes impossible. At this time, it is assumed that torque acting on a connection portion between the rotary shaft of the vane main body and the link member becomes larger, as compared to that at the time of the normal operation. Here, by using such a torque limiter section, it is possible to operate only the link member by enabling relative rotation between the vane main body and the link member even in a state where one vane main body does not operate. Due to this, it becomes possible to operate other vane main bodies by operating the annular member, and therefore, the centrifugal compressor does not completely lose a flow rate adjustment function, thereby leading to improvement in reliability and usability.

Advantageous Effects of Invention

According to the centrifugal compressor described above, a rotational force is directly applied to the annular member by the drive mechanism, whereby it becomes possible to reduce a cost and accurately adjust a flow rate. In addition, a reduction in the size of the entire centrifugal compressor and efficiency improvement also become possible.

DESCRIPTION OF EMBODIMENTS

First Embodiment

Hereinafter, a centrifugal compressor 1 according to a first embodiment of the present invention will be described.

The centrifugal compressor 1 is a compressor which is used in, for example, a turbo refrigerator or the like. The centrifugal compressor 1 compresses a fluid F while causing the fluid F to flow toward the downstream side (the left side in the plane of FIG. 1) which is one side in a direction of an axis line O along the axis line O.

Figure 1:
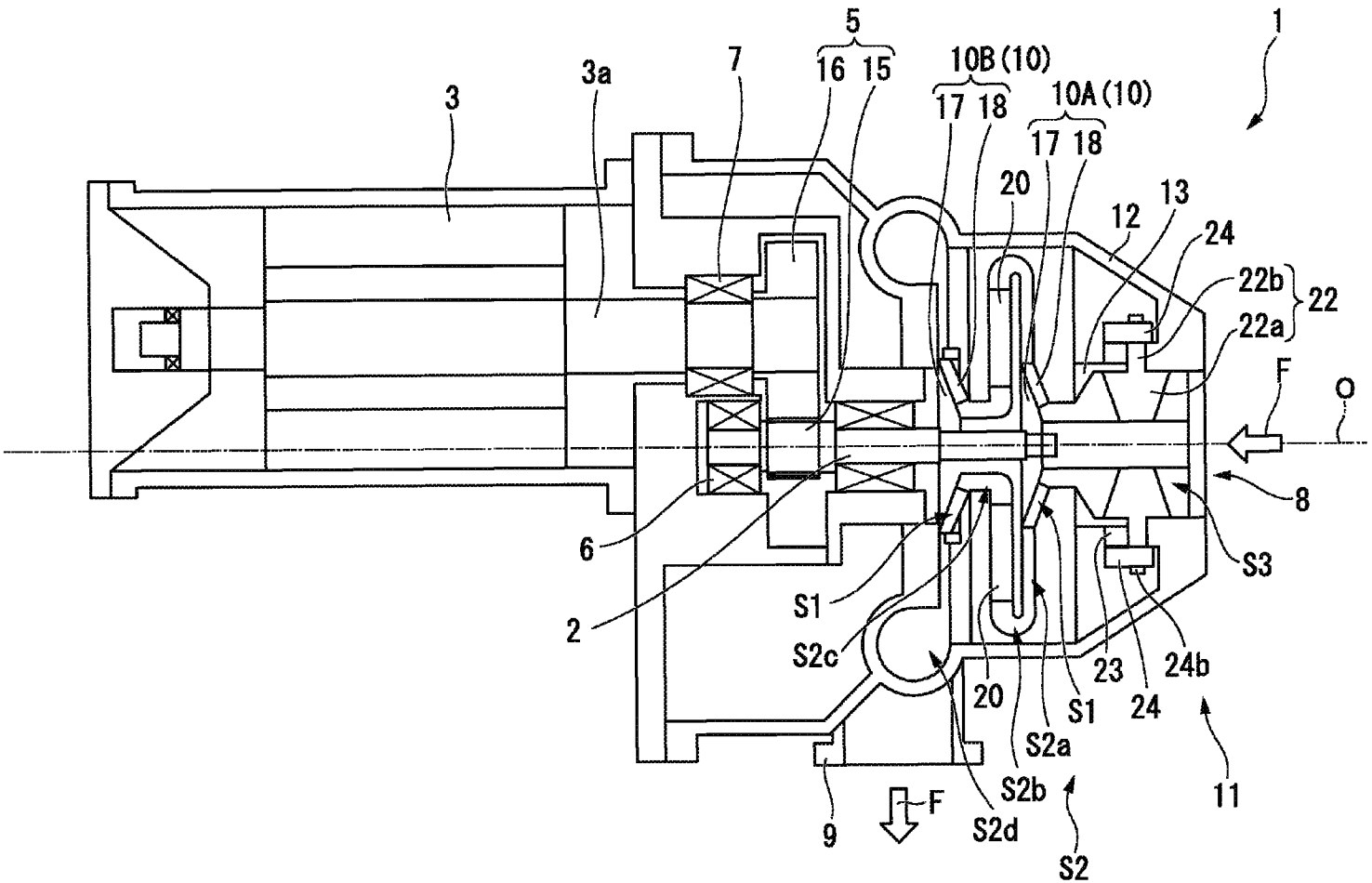
FIG. 1 is an overall cross-sectional view showing a centrifugal compressor according to a first embodiment of the present invention.

As shown in FIG. 1, the centrifugal compressor 1 mainly includes a main shaft 2 extending with the axis line O as the center, a two-stage impeller (bladed wheel) 10 externally fitted to the main shaft 2, a main electric motor 3 applying a rotational force to the main shaft 2, a gear mechanism 5 transmitting the rotational force of the main electric motor 3 to the main shaft 2, a vane device 11 provided on the upstream side of the impeller 10, and a casing 12 provided so as to cover them from the outer periphery.

The main shaft 2 has a columnar shape extending in the direction of the axis line O of the main shaft as the center. The main shaft 2 is supported by a bearing 6 provided in the casing 12 so as to be able to rotate around the axis line O.

The main electric motor 3 generates rotary power for the main shaft 2. Then, a main output shaft 3*a* is supported by a bearing 7 provided in the casing 12 so as to be parallel to the main shaft 2, and is provided to be spaced apart from the main shaft 2 in a radial direction with respect to the axis line O of the main shaft.

The gear mechanism 5 has a main shaft gear 15 which is externally fitted to the main shaft 2 and rotates around the axis line O along with the main shaft 2, and an output shaft gear 16 which is externally fitted to the main output shaft 3*a* and rotates along with the main output shaft 3*a*. The main shaft gear 15 and the output shaft gear 16 mesh with each other in the radial direction, whereby the rotary power of the main output shaft 3*a* is transmitted to the main shaft 2 as the rotational force of the main shaft 2.

The impellers 10 which are provided in two stages rotate around the axis line O along with the main shaft 2. Further, each of the impellers 10 has a substantially disk-shaped disk 17 in which a diameter gradually increases as it proceeds to the downstream side, and a plurality of blades 18 radially mounted on the disk 17 so as to rise from the surface of the disk 17 to the other side (the right side in the plane of FIG. 1) of the axis line O and arranged in a circumferential direction. Then, an area surrounded by the blades 18 adjacent to each other in the circumferential direction and the surface of the disk 17 configures a compression flow path S1 in which the fluid F flows, thereby being compressed. Here, the impeller 10 provided on the upstream side is referred to as a first stage impeller 10A, and the impeller 10 provided on the downstream side is referred to as a second stage impeller 10B.

In addition, the impeller 10 need not have a two-stage configuration as in this embodiment and may have a single stage or may be provided in three or more stages.

The casing 12 is a member forming the outer shape of the centrifugal compressor 1. In the casing 12, an opening portion centered on the axis line O is provided on the other side in the direction of the axis line O of the main shaft, and the opening portion serves as a suction port 8 taking in the fluid F from outside. Further, an inner casing 13 is provided in an internal space between the first stage impeller 10A and the suction port 8 so as to make the suction port 8 and the compression flow path S1 of the first stage impeller 10A communicate with each other. A cylindrical space centered on the axis line O is defined in the internal space by the inner casing 13, and the cylindrical space serves as an inflow flow path S3 of the fluid F, thereby allowing the fluid F taken in from the suction port 8 to be introduced into the compression flow path S1.

Further, in the casing 12, a flow path S2 making the compression flow paths S1 of the first stage impeller 10A and the second stage impeller 10B communicate with each other is formed between the first stage impeller 10A and the second stage impeller 10B.

Specifically, the flow path S2 is composed of a first stage diffuser flow path S2*a* into which the fluid F having flowed through the compression flow path S1 toward the outside from the inside in the radial direction flows, a return flow path S2*b* which is continuous with the first stage diffuser flow path S2*a*, and a suction flow path S2*c* which is continuous with the return flow path S2*b*, thereby causing the fluid F to flow into the compression flow path S1 of the second stage impeller 10B.

The first stage diffuser flow path S2*a* is formed to have an annular shape centered on the axis line O so as to communicate with the compression flow path S1 of the first stage impeller 10A, and so as to extend radially outward.

The return flow path S2*b* is formed to have an annular shape centered on the axis line O and so as to be bent toward one side in the direction of the axis line O of the main shaft so as to be directed from the outside in the radial direction to the inside, thereby changing a flow direction of the fluid F.

The suction flow path S2*c* is formed to have an annular shape centered on the axis line O and so as to extend radially inward, thereby communicating with the compression flow path S1 of the second stage impeller 10B. Further, in the suction flow path S2*c*, a return vane 20 is provided.

In addition, in the casing 12, a second stage diffuser flow path S2*d* is formed which has an annular shape centered on the axis line O and extends radially outward so as to communicate with the compression flow path S1 of the second stage impeller 10B, whereby the fluid F having flowed through the compression flow path S1 flows thereinto. Then, an opening portion is provided to be continuous with the second stage diffuser flow path S2*d* and toward the outside in the radial direction with respect to the axis line O of the main shaft at a portion in the circumferential direction of the casing 12. The opening portion serves as a discharge port 9 which discharges the fluid F from the second stage diffuser flow path S2*d* to the outside.

Next, the vane device 11 will be described.

The vane device 11 is provided in the inner casing 13 and disposed to be sandwiched between the first stage impeller 10A and the suction port 8 of the casing 12 in the direction of the axis line O of the main shaft, thereby adjusting the flow rate of the fluid F from the suction port 8.

Figure 2:
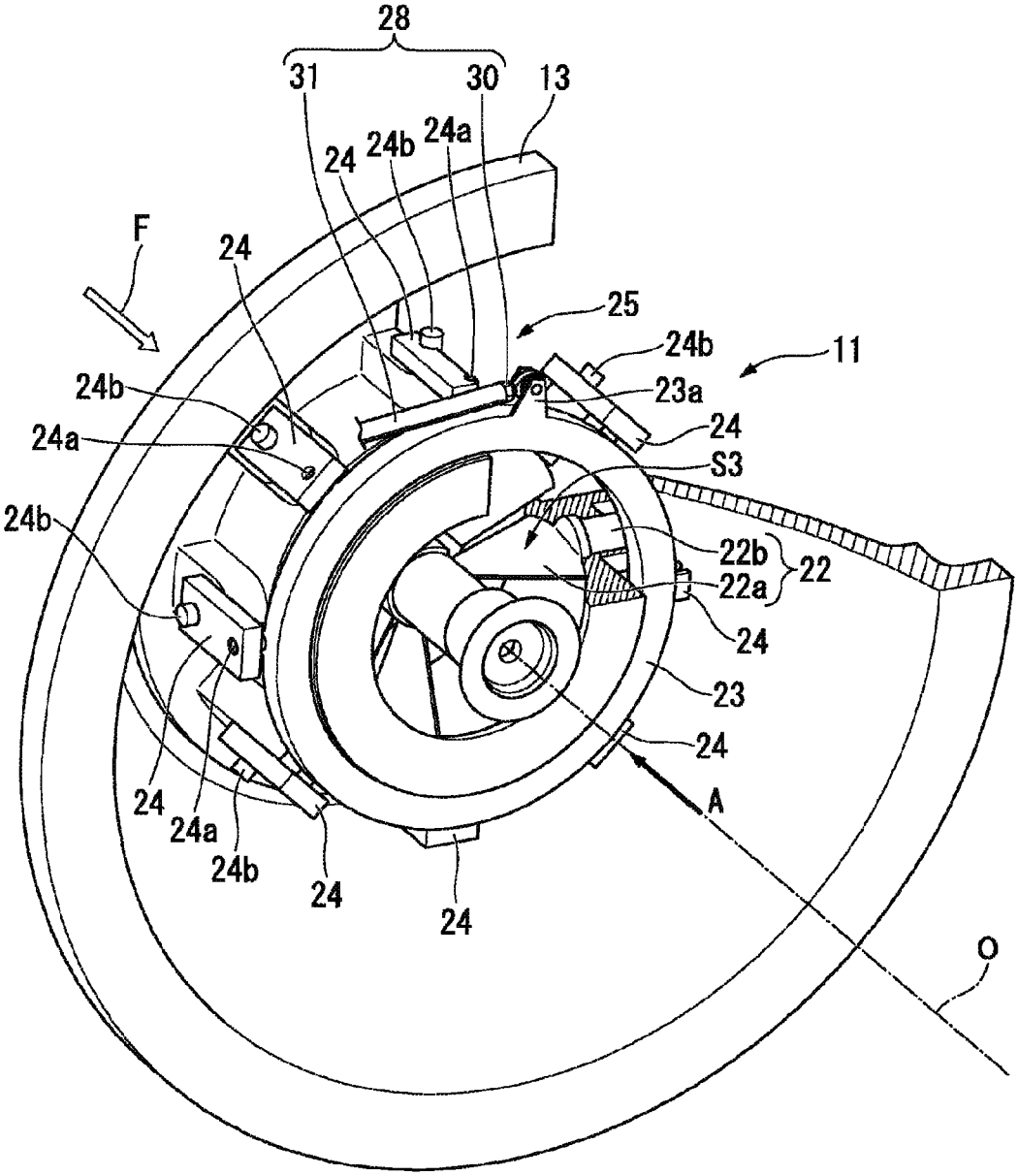
FIG. 2 is related to the centrifugal compressor according to the first embodiment of the present invention and is a perspective view, in a partial cut away, showing an inner casing and a drive mechanism.
Figure 3:
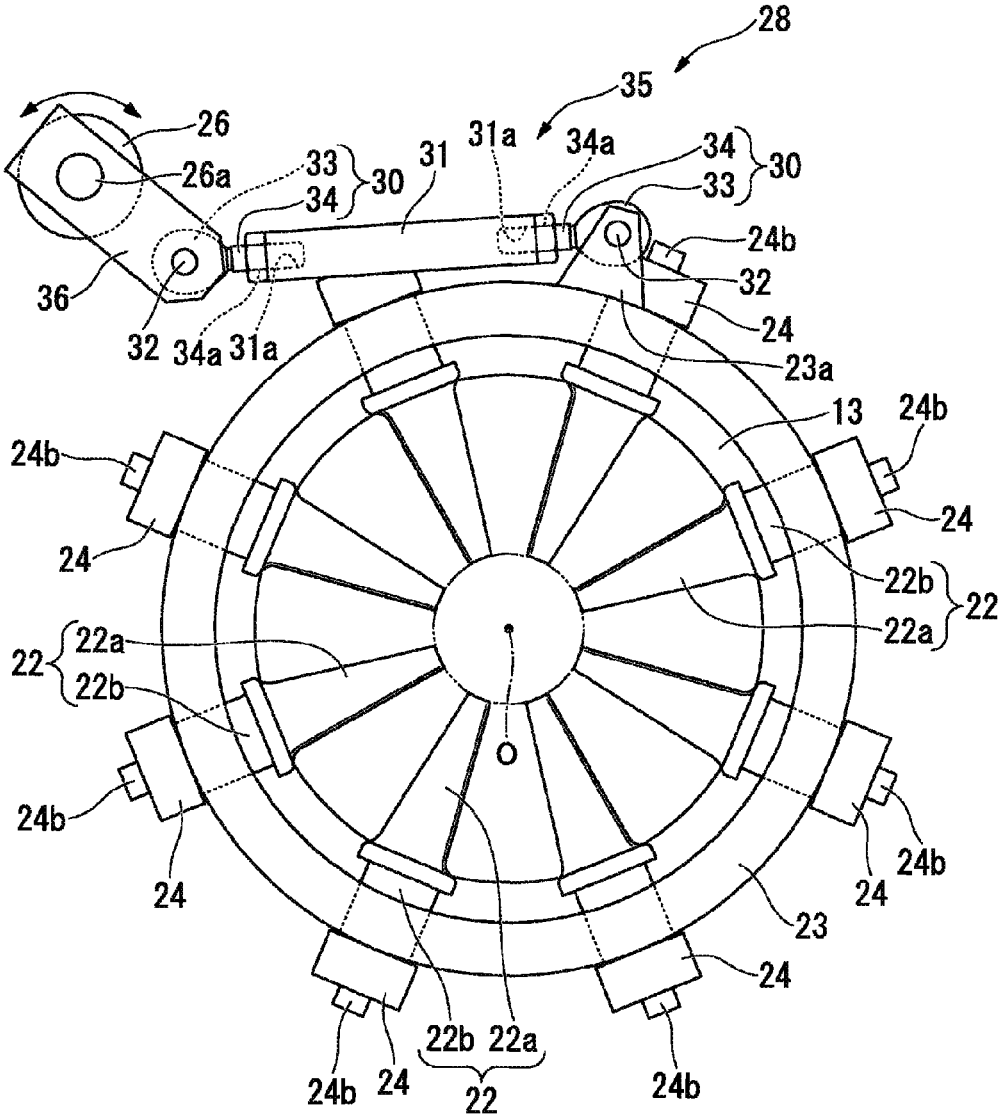
FIG. 3 is related to the centrifugal compressor according to the first embodiment of the present invention and is a diagram when the drive mechanism is viewed from a direction of an axis line and is a diagram as viewed from the direction of an arrow A of FIG. 2.
Figure 4:
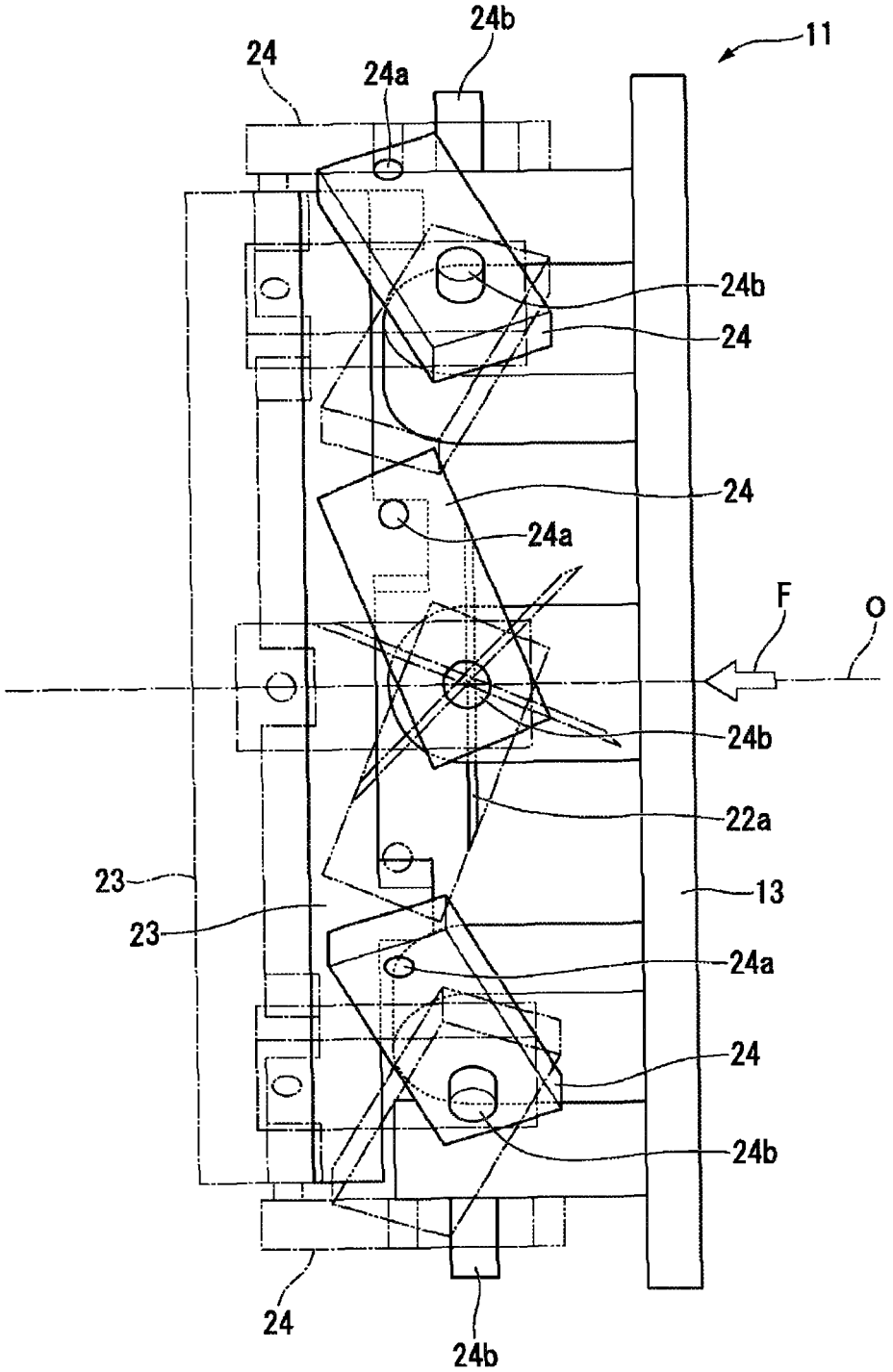
FIG. 4 is related to the centrifugal compressor according to the first embodiment of the present invention and is a diagram when the drive mechanism is viewed from a radial direction and is a diagram showing an opening and closing operation of an operation.

As shown in FIGS. 2 to 4, the vane device 11 is provided with a plurality of vane main bodies 22 provided at intervals in the circumferential direction in the inflow flow path S3, a drive ring (an annular member) 23 provided on the downstream side of the vane main bodies 22 and having an annular shape centered on the axis line O, a link member 24 which connects the drive ring 23 and each vane main body 22, and a drive mechanism 25 which drives the drive ring 23.

Each vane main body 22 has a blade portion 22*a* which is disposed in the inflow flow path S3, and a shaft portion (a rotary shaft) 22*b* which extends radially outward from the blade portion 22*a*.

The blade portion 22*a* is a plate-shaped member having a substantially fan shape in which a width dimension becomes smaller toward the inside in the radial direction. Here, the main shaft 2 described above extends to the other side in the axial direction further to the upstream side than the blade portion 22*a* of the vane main body 22. A tip portion on the inside in the radial direction of the blade portion 22*a* extends to a position where a state is created where there is no gap between the position and the position of the outer peripheral surface of the main shaft 2.

The shaft portion 22*b* has a columnar shape. The shaft portion 22*b* is provided so as to protrude toward the outside in the radial direction with respect to the axis line O of the main shaft from the end face on the outside in the radial direction of the blade portion 22*a*. Further, the shaft portion 22*b* radially penetrates the inner casing 13 defining the inflow flow path S3 and is mounted so as to be able to relatively rotate with respect to the inner casing 13.

The link member 24 has a rectangular parallelepiped block shape, is provided on the outer peripheral surface of the inner casing 13. A first end of the link member 24 is connected to an end portion on the outside in the radial direction of the shaft portion 22*b* of each vane main body 22 by a pin 24*b*, whereby the link member 24 can rotate integrally with the shaft portion 22*b*. Due to this, if the link member 24 rotates, the vane main body 22 also rotates, thereby operating such that the angle of the blade portion 22*a* changes.

As shown in FIG. 4, in this embodiment, the link member 24 and the vane main body 22 are connected such that a direction in which the surface of the blade portion 22*a* of the vane main body 22 faces is inclined with respect to a longitudinal direction of the link member 24.

The drive ring 23 has an annular shape centered on the axis line O, is mounted on the outer peripheral surface of the inner casing 13 further toward the downstream side being one side in the axial direction than a mounting position of the vane main body 22, and is provided so as to be able to relatively rotate between itself and the inner casing 13 and slide in the axial direction. Further, a second end of link member 24 is connected to the outer peripheral surface of the drive ring 23 via a pin 24*a*, and thus the drive ring 23 and the link member 24 can relatively rotate with respect to each other with the pin 24*a* as the center and slide together. Further, a projection portion 23*a* protruding radially outward between the link members 24 adjacent to each other is provided on the outer peripheral surface of the drive ring 23.

Next, the drive mechanism 25 of the drive ring 23 will be described.

As shown in FIG. 3, the drive mechanism 25 has an electric motor 26 which serves as a driving source, and a transmission arm 28 which transmits the power of the electric motor 26 to the drive ring 23.

The electric motor 26 is disposed inside the casing 12 and at a position on the outside in the radial direction of the drive ring 23 and is provided with an output shaft 26*a* which is provided parallel to the axis line O and rotates.

The transmission arm 28 extends along the circumferential direction with respect to the axis line O of the main shaft on the outer periphery side of the drive ring 23 and is provided between the output shaft 26*a* and the projection portion 23*a* formed on the outer peripheral surface of the drive ring 23.

Then, the transmission arm 28 has a driving lever 36 fixedly connected to the output shaft 26*a*, and a driving link bar 35 provided between the driving lever 36 and the projection portion 23*a* of the drive ring 23 and connected to them.

The driving lever 36 is a plate-shaped member which is extends toward the outside in the radial direction of the output shaft 26*a*, and rotates along with the output shaft 26*a*. A first end of the driving lever 36 is fixed to the output shaft 26*a*.

The driving link bar 35 is provided with a connecting rod-shaped portion 31 extending along the circumferential direction with respect to the axis line O of the main shaft on the outer periphery side of the drive ring 23, and universal joints 30 provided at both ends of the connecting rod-shaped portion 31. A first end of the driving link bar 35 is connected to a second end of the driving lever 36 through the universal joint 30 and a pin 32. A second end of the driving link bar 35 is connected to the projection portion 23*a* of the drive ring 23 through the universal joint 30 and the pin 32.

In the connecting rod-shaped portion 31, a female threaded portion 31*a* (a second threaded portion) is provided on the inside thereof so as to be recessed in an extending direction of the connecting rod-shaped portion 31 from the end face of the connecting rod-shaped portion 31.

The universal joint 30 is provided with a spherical bearing 33 which three-dimensionally rotates and is connected to each of the driving lever 36 and the projection portion 23*a* through the pin 32 in a state of being inserted therein from the direction of the axis line O, and a rod-shaped portion 34 which holds the spherical bearing 33 and extends toward the connecting rod-shaped portion 31, that is, along the circumferential direction with respect to the axis line O of the main shaft. A male threaded portion 34*a* (a first threaded portion) is provided with the outer peripheral surface of the rod-shaped portion 34. The male threaded portion 34*a* is screwed with the female threaded portion 31*a* of the connecting rod-shaped portion 31, and thus these are joined together, whereby the driving link bar 35 is configured.

Next, an operation of the vane device 11 will be described.

First, if the electric motor 26 of the drive mechanism 25 is driven and thus the output shaft 26*a* rotates, the driving lever 36 rotates. Due to the rotation of the driving lever 36, the driving link bar 35 is pulled or pushed along the circumferential direction according to a rotation direction of the output shaft 26*a*. Accordingly, the transmission arm 28 moves back and forth along the circumferential direction with respect to the axis line O of the main shaft on the outer periphery side of the drive ring 23, thereby rotating the drive ring 23 around the axis line O.

In this way, if a force is transmitted in a tangential direction to the drive ring 23 and thus the drive ring 23 rotates and moves in the circumferential direction, a force acts such that the pin 24*a* of the link member 24 is pressed or pulled according to a rotation direction of the drive ring 23. Then, due to the force, the link member 24 is rotated along with the shaft portion 22*b* with the shaft portion 22*b* of the vane main body 22 as the center. At this time, the drive ring 23 moves in the axial direction along a locus of rotation of the link member 24.

Then, in this manner, if the link member 24 is rotated, the blade portion 22*a* is rotated with the shaft portion 22*b* as the center, and thus a mounting angle of the vane main body 22 changes.

More specifically, if the electric motor 26 is driven so as to push the drive ring 23 toward the other side from one side (the left side in the plane of FIG. 3) in the circumferential direction in FIG. 3, the link member 24 rotates so as to reach a position of a dashed-dotted line from a position of a solid line, as shown in FIG. 4, and accordingly, the vane main body 22 also rotates, and thus the vane device 11 transitions from a fully closed state to an open state. Further, at this time, the drive ring 23 moves so as to be pushed toward the downstream side which is one side in the axial direction so as to reach a position of a dashed-dotted line from a position of a solid line.

Further, if the degree of opening of the vane device 11 is further increased, the link member 24 further rotates so as to reach a position of a two-dot chain line from the position of a dashed-dotted line, and thus, now, the drive ring 23 moves so as to be pulled toward the upstream side which is the other side in the axial direction by the link member 24.

Here, in this embodiment, in a state where the link member 24 is inclined in the clockwise direction in the plane of FIG. 4 from the direction of the axis line O, the surface of the blade portion 22*a* faces exactly the direction of the axis line O and a fully closed state is created where the blade portion 22*a* completely blocks the inflow flow path S3. Then, the direction in which the surface of the blade portion 22*a* faces is gradually inclined from the direction of the axis line O as the link member 24 rotates in the counterclockwise direction in the plane of FIG. 4 from the fully closed state, whereby the inflow flow path S3 is opened.

In the centrifugal compressor 1, the vane device 11 is provided, whereby the flow rate of the fluid F flowing through the inflow flow path S3 can be adjusted by changing the angles of the vane main bodies 22 by rotating all of the link members 24 by rotating the drive ring 23 by the drive mechanism 25.

Here, for example, in the fully closed state of the vane device 11 where the flow rate of the fluid F becomes zero, the vane main body 22 is pressed in the axial direction due to a difference in pressure between the suction side which is the upstream side and the discharge side which is the downstream side, and thus a large force is sometimes required for an opening and closing operation.

Even in such a case, since a rotational force is directly applied to the drive ring 23 by the drive mechanism 25, it becomes possible to uniformly apply the rotational force to all of the link members 24.

Therefore, it is possible to smoothly rotate all of the link members 24, and thus it is possible to adjust the mounting angle of the vane main body 22 while reducing the power of the electric motor 26 of the drive mechanism 25.

In addition, in the drive ring 23, in addition to the movement in the circumferential direction, the movement in the direction of the axis line O of the main shaft is also possible. This is a structure in which a backlash is not provided in the direction of the axis line O of the main shaft according to the rotational motion of the link member 24 in advance, but an operation in the direction of the axis line O of the main shaft is actively allowed. Therefore, when the drive ring 23 is operated, the drive ring 23 is not inclined with respect to the direction of the axis line O of the main shaft, that is, galling does not occur, and thus the degree of accuracy of the adjustment of the degree of opening of a vane is not reduced.

Further, a rotational force is transmitted to the drive ring 23 by the transmission arm 28 and a structure is simple, and therefore, a reduction in cost is possible.

In addition, in the transmission arm 28, the driving lever 36 and the drive ring 23 are connected through the universal joints 30, whereby when the rotational force of the electric motor 26 is transmitted to the drive ring 23 by the transmission arm 28, the transmission arm 28 can be smoothly operated three-dimensionally. Therefore, even in a state where the drive ring 23 moves in the direction of the axis line O of the main shaft in accordance with the movement in the circumferential direction, it becomes possible to reliably transmit a force from the electric motor 26 to the drive ring 23 without interfering with the operation. Therefore, it is possible to more accurately adjust the flow rate of the fluid F flowing through the inflow flow path S3.

According to the centrifugal compressor 1 of this embodiment, since it is possible to smoothly operate all of the link members 24 by directly applying a rotational force to the drive ring 23, it becomes possible to reduce a cost and accurately adjust a flow rate.

Second Embodiment

Next, a centrifugal compressor 51 according to a second embodiment of the present invention will be described.

In addition, constituent elements which are shared with the first embodiment are denoted by the same reference numerals and detailed description is omitted.

In this embodiment, a transmission arm 58 is different from that of the first embodiment.

Figure 5A:
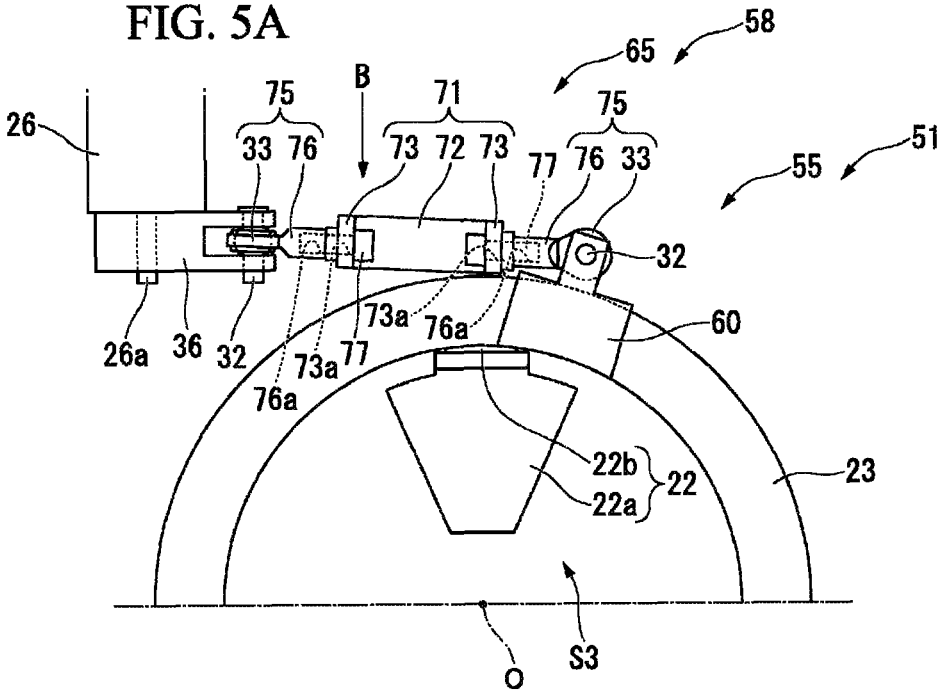
FIG. 5A is related to a centrifugal compressor according to a second embodiment of the present invention and is a diagram when a drive mechanism is viewed from the direction of an axis line.
Figure 5B:
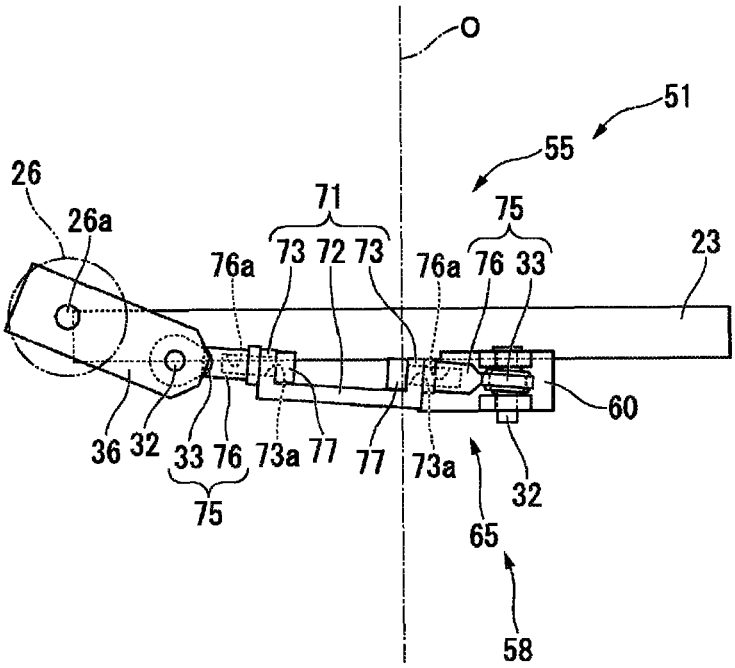
FIG. 5B is related to the centrifugal compressor according to the second embodiment of the present invention and is a diagram as viewed from the direction of an arrow B of FIG. 5A.

As shown in FIGS. 5A and 5B, the transmission arm 58 has the driving lever 36 fixedly connected to the output shaft 26*a*, similar to the first embodiment, and a driving link bar 65 provided between the driving lever 36 and a projection portion 60 of the drive ring 23 and connected to them.

A connecting rod-shaped portion 71 in the driving link bar 65 has a rectangular portion 72 extending along the circumferential direction with respect to the axial direction on the outer periphery side of the drive ring 23, and bent portions 73 formed integrally with the rectangular portion 72 so as to be bent at a right angle toward the upstream side in the axial direction at both end portions of the rectangular portion 72. In each of the bent portions 73, a through-hole 73*a* penetrating in an extending direction of the rectangular portion 72 is formed.

A universal joint 75 in the driving link bar 65 is provided with the spherical bearing 33, and a rod-shaped portion 76 which holds the spherical bearing 33 and extends toward the bent portion 73 of the connecting rod-shaped portion 71, that is, along the circumferential direction with respect to the axis line O of the main shaft. In the rod-shaped portion 76, a female threaded portion 76*a* (the first threaded portion) is provided so as to be recessed in an extending direction from the end face thereof.

Then, a bolt (the second threaded portion) 77 is provided to be inserted into the through-hole 73*a* of the bent portion 73, and the bolt 77 is screwed into the female threaded portion 76*a* of the rod-shaped portion 76 in a state where the rod-shaped portion 76 of the universal joint 75 comes into contact with the bent portion 73, whereby the driving link bar 65 is configured.

Here, in this embodiment, unlike the first embodiment, the electric motor 26 is provided such that the output shaft 26*a* is orthogonal to the axis line O. Further, the projection portion 60 of the drive ring 23 is mounted as a separate body so as to come into contact with the surface facing the downstream side in the axial direction. However, these may be provided in the same way as in the first embodiment.

According to the centrifugal compressor 51 of this embodiment, when mounting the universal joint 75 on the driving link bar 65 and joining them together, the bolt 77 is fastened in a state of bringing the rod-shaped portion 76 into contact with the driving link bar 65. Therefore, the total length dimension that is the sum of the length of the driving link bar 65 and the length of the universal joint 75, that is, the length dimension of the transmission arm 58, is always the same dimension irrespective of which worker performs fastening work.

Accordingly, since work required for the length adjustment of the transmission arm 58 is not necessary, the time required for assembly is shortened, thereby leading to improvement in workability.

In addition, in this embodiment, a male threaded portion which is screwed into the female threaded portion 76*a* of the rod-shaped portion 76 of the universal joint 75 is the bolt 77. However, for example, instead of the bolt 77, a male threaded portion may be integrally provided in the connecting rod-shaped portion 71 so as to protrude from the bent portion 73 of the connecting rod-shaped portion 71 and be screwed into the female threaded portion 76*a*.

Third Embodiment

Next, a centrifugal compressor 81 according to a third embodiment will be described.

In addition, constituent elements which are shared with the first embodiment and the second embodiment are denoted by the same reference numerals and a detailed description is omitted.

In this embodiment, a basic configuration is the same as that of the centrifugal compressor 51 of the second embodiment and a transmission arm 83 of a drive mechanism 82 is different from that of the second embodiment.

Figure 6:
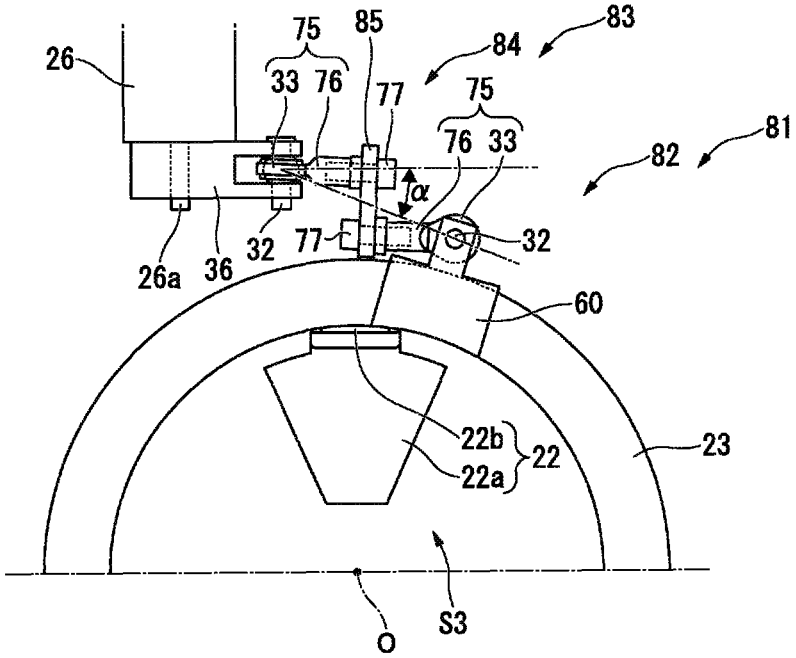
FIG. 6 is related to a centrifugal compressor according to a third embodiment of the present invention and is a diagram when a drive mechanism is viewed from the direction of an axis line.

As shown in FIG. 6, the transmission arm 83 has the driving lever 36 fixedly connected to the output shaft 26*a*, and a driving link member 84 provided between the driving lever 36 and the projection portion 60 of the drive ring 23 and connected thereto.

The driving link member 84 is provided with a connection portion 85 having a plate shape extending in the radial direction with respect to the axis line O of the main shaft so as to be spaced apart from the drive ring 23, and the two universal joints 75 provided at the connection portion 85.

Then, one of the two universal joints 75 is connected to the driving lever 36 and the other is connected to the drive ring 23. Further, the universal joints 75 are mounted on the connection portion 85 by the bolts 77 so as to be spaced apart from each other in the radial direction with respect to the axis line O of the main shaft in the connection portion 85.

That is, the two universal joints 75 are not provided so as to connect the driving lever 36 and the drive ring 23 in a straight line, but provided in a state of being offset.

According to the centrifugal compressor 81 of this embodiment, even if an installation position of the electric motor 26 is spaced apart from the drive ring 23 in the radial direction, it is possible to reliably connect the driving lever 36 and the drive ring 23 by the transmission arm 83.

More specifically, for example, in a small centrifugal compressor, the drive ring 23 has a small diameter and the relative positional relationship between the drive ring 23 and the electric motor 26 can also be changed, as compared to the centrifugal compressor 51 of the second embodiment. Then, in a case where the electric motor 26 and the drive ring 23 are spaced apart from each other, if the driving lever 36 and the drive ring 23 are connected with a straight line, as shown in FIG. 6, the deflection angle of the spherical bearing 33 is a and the deflection angle $\alpha$ sometimes exceeds the range of movement of the spherical bearing 33.

In this regard, the two universal joints 75 are provided to be offset through the connection portion 85, as in this embodiment, whereby it becomes possible to keep the deflection angle of the spherical bearing 33 within the range of movement. For this reason, it is possible to reliably connect the driving lever 36 and the drive ring 23, regardless of the installation position of the electric motor 26.

Further, similar to the second embodiment, work required for the length adjustment of the transmission arm 83 is not necessary, and therefore, the time required for assembly is shortened, thereby leading to improvement in workability.

In addition, even in a case where the installation position of the electric motor 26 is spaced apart from the drive ring 23 in the axial direction or in a case where the installation position of the electric motor 26 is spaced apart from the drive ring 23 in the axial direction and the radial direction, it is possible to apply the transmission arm 83 in the same manner,

Fourth Embodiment

Next, a centrifugal compressor 91 according to a fourth embodiment will be described.

In addition, constituent elements which are shared with the first embodiment to the third embodiment are denoted by the same reference numerals and a detailed description thereof is omitted.

Figure 7:
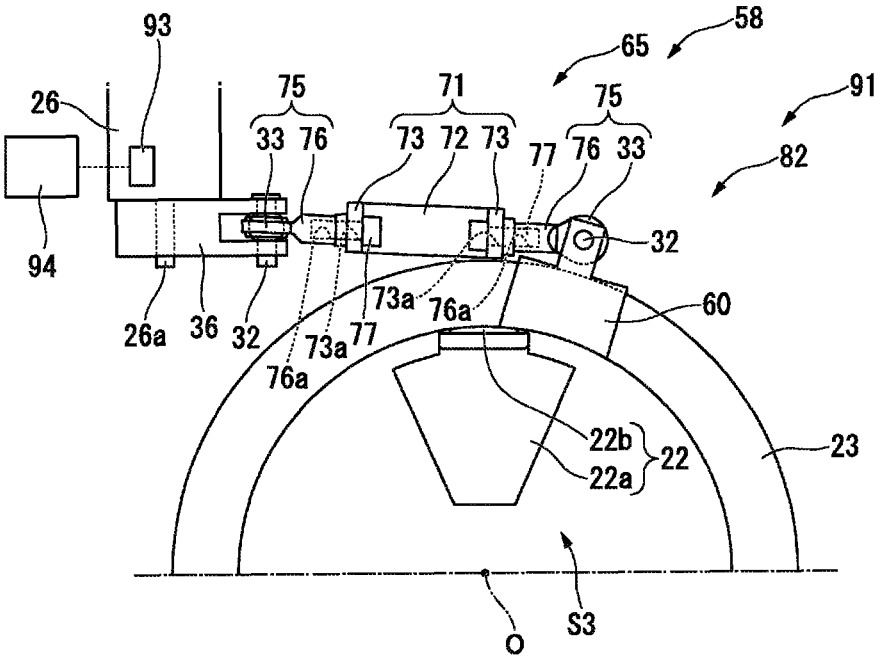
FIG. 7 is related to a centrifugal compressor according to a fourth embodiment of the present invention and is a diagram when a drive mechanism is viewed from the direction of an axis line.

As shown in FIG. 7, in this embodiment, a basic configuration is the same as that of the centrifugal compressor 51 of the second embodiment and a torque detection section 93 and a control section 94 performing the control of the electric motor 26 are further provided.

The torque detection section 93 detects the torque of the electric motor 26 and outputs a detection signal to the control section 94. As the torque detection section 93, for example, a current sensor which detects a current value of the electric motor 26, a strain gauge installed at the output shaft 26*a* of the electric motor 26, or the like can be used.

The control section 94 receives the detection signal from the torque detection section 93 and reversely rotates the output shaft 26*a* of the electric motor 26 in a case where the value of the detection signal exceeds a threshold value set in advance. Otherwise, the control section 94 rotates the output shaft 26*a* in a direction at the time of a normal operation again after the output shaft 26*a* is reversely rotated once, or repeats a change of a rotation direction a predetermined number of times.

According to the centrifugal compressor 91 of this embodiment, for example, in a case where the drive ring 23, the link member 24, or the like does not smoothly operate due to some cause, the torque of the electric motor 26 is increased, as compared to that at the time of a normal operation.

Here, in this manner, if the torque of the electric motor 26 is increased, the current value of the electric motor 26 is also increased, and therefore, in the control section 94, a current value corresponding to the torque of the electric motor 26 at the time of a normal operation is set as the above-described threshold value, and if the current value of the electric motor 26 exceeds the threshold value, the electric motor 26 is controlled by the control section 94. Accordingly, it becomes possible to return the drive ring 23, the link member 24, or the like to a normal operation state. That is, a current sensor is used as the torque detection section 93 and the output shaft 26*a* of the electric motor 26 is reversely rotated at least once, whereby it is possible to return the drive ring 23, the link member 24, or the like to the normal operation state.

Further, if the torque of the electric motor 26 is increased, strain occurs in the output shaft 26*a* of the electric motor 26. For this reason, in the control section 94, the amount of strain of the output shaft 26*a* corresponding to the torque of the electric motor 26 at the time of the normal operation is set as the above-described threshold value, whereby it is possible to return the drive ring 23, the link member 24, or the like to the normal operation state by controlling the electric motor 26 by adopting a strain gauge as the torque detection section 93.

Therefore, for example, even if galling occurs in the drive ring 23 and thus the vane main body 22 does not operate, it is possible to automatically return the drive ring 23, the link member 24, or the like to the normal operation state without performing maintenance and the angle adjustment of the vane main body 22 becomes possible. For this reason, the control of the degree of opening does not become impossible immediately, and thus it is possible to achieve an improvement in reliability and usability.

In addition, in addition to a case of using a current sensor or a strain gauge as the torque detection section 93, for example, a monitoring device which monitors the state of the torque of the electric motor 26 and monitors the states of the operation and the stopping of the vane main body 22 may be provided. Then, for example, if there is a situation where the vane main body 22 does not operate even though the torque of the electric motor 26 is generated, it is assumed that the drive ring 23, the link member 24, or the like does not enter the normal operation state. Therefore, in this case, by performing the control of the electric motor 26 by using the control section 94, as described above, it is possible to return the drive ring 23, the link member 24, or the like to the normal operation state.

Further, in this manner, it is also possible to perform the remote monitoring of an operating state by recording the detection signal from the torque detection section 93 by a data logger or the like. Further, alarm means for issuing a warning in a case where the detection signal from the torque detection section 93 exceeds the above-described threshold value is separately provided, and it is also possible to determine the necessity of maintenance by checking a warning of the alarm means through an internet line or the like.

Fifth Embodiment

Next, a centrifugal compressor 101 according to a fifth embodiment will be described.

In addition, constituent elements which are shared with the first embodiment to the fourth embodiment are denoted by the same reference numerals and a detailed description is omitted.

In this embodiment, a basic configuration is the same as that of the centrifugal compressor 51 of the second embodiment and a transmission arm 103 of a drive mechanism 102 is different from that of the second embodiment.

Figure 8A:
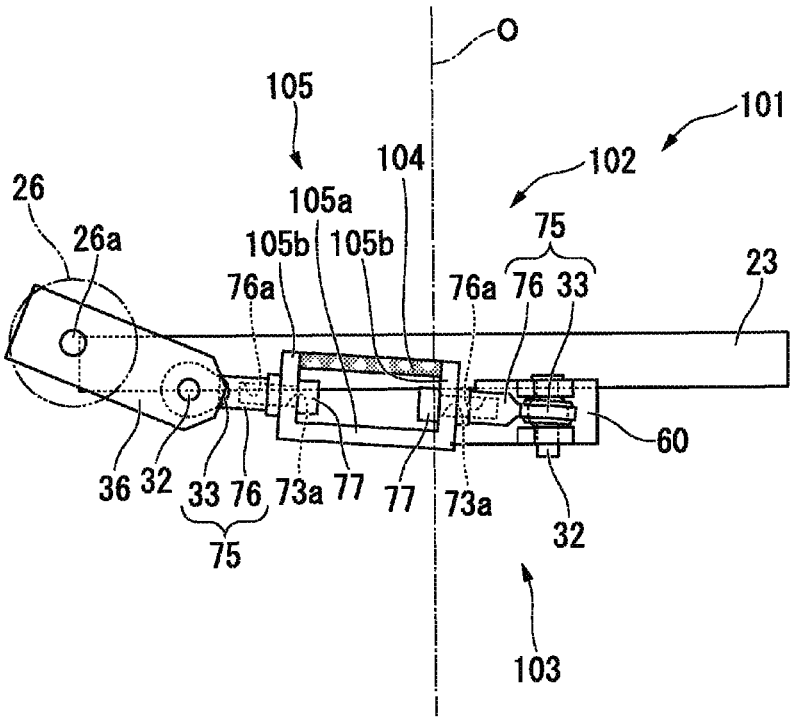
FIG. 8A is related to a centrifugal compressor according to a fifth embodiment of the present invention and is a diagram showing a first example of a diagram when a drive mechanism is viewed from the radial direction.
Figure 8B:
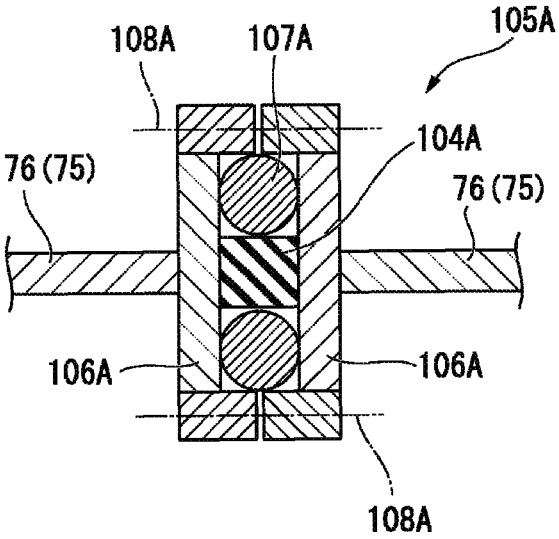
FIG. 8B is related to the centrifugal compressor according to the fifth embodiment of the present invention and is a diagram showing only a driving link member in an enlarged manner with respect to a second example of a diagram when the drive mechanism is viewed from the radial direction.

As shown in FIGS. 8A and 8B, the transmission arm 103 has the driving lever 36 fixedly connected to the output shaft 26*a*, and a driving link member 105 provided between the driving lever 36 and the projection portion 60 of the drive ring 23 and connected thereto The driving link member 105 has the two universal joints 75, a rectangular portion 105*a* having a shape equivalent to that of the rectangular portion 72 of the second embodiment, and a bent portion 105*b* having a shape equivalent to that of the bent portion 73, as shown in FIG. 8A. Further, the driving link member 105 has a damping member 104 provided between the two universal joints 75 so as to be sandwiched between two bent portions 105*b*. The damping member 104 is formed of a material such as, for example, hard rubber.

Here, as shown in FIG. 8B, the transmission arm 103 may have a driving link member 105A instead of the driving link member 105.

Specifically, the driving link member 105A has the two universal joints 75, and a pair of flange portions 106A provided at the respective universal joints 75 between the universal joints 75 and protruding in a direction orthogonal to an extending direction of the rod-shaped portion 76 of the universal joint 75.

In addition, the driving link member 105A has an O-ring 107A provided so as to be sandwiched between the pair of flange portions 106A, and a damping member 104A disposed on the inside in the radial direction of the O-ring 107A and formed of a material such as hard rubber.

Further, a bolt 108A is provided which fastens and fixes the pair of flange portions 106A in a state where the pair of flange portions 106A face each other and the O-ring 107A and the damping member 104A are sandwiched between the pair of flange portions 106A.

According to the centrifugal compressor 101 of this embodiment, the damping member 104 (104A) is applied to the transmission arm 103, whereby it becomes possible to suppress a vibration phenomenon such as self-excited vibration by the fluid F which flows in. For this reason, it is possible to prevent wear or deterioration of components of the centrifugal compressor 101, and thus it becomes possible to prolong a product life.

In particular, in the driving link member 105A shown in FIG. 8B, it is possible to receive a tensile force through the bolt 108A and receive a compression force through the damping member 104A. For this reason, it is possible to more effectively suppress the vibration phenomenon.

In addition, in the transmission arm 103 of this embodiment, the damping member 104 or 104A is not limited to that described above and may be any member capable of damping an acting force by being interposed between the universal joints 75.

Further, it is also possible to apply the transmission arm 103 of this embodiment to the centrifugal compressors 1, 81, and 91 of the first embodiment, the third embodiment, and the fourth embodiment.

Sixth Embodiment

Next, a centrifugal compressor 111 according to a sixth embodiment will be described.

In addition, constituent elements which are shared with the first embodiment to the fifth embodiment are denoted by the same reference numerals and a detailed description is omitted here.

In this embodiment, a vane main body 112 is different from those of the first embodiment to the fifth embodiment.

Figure 9:
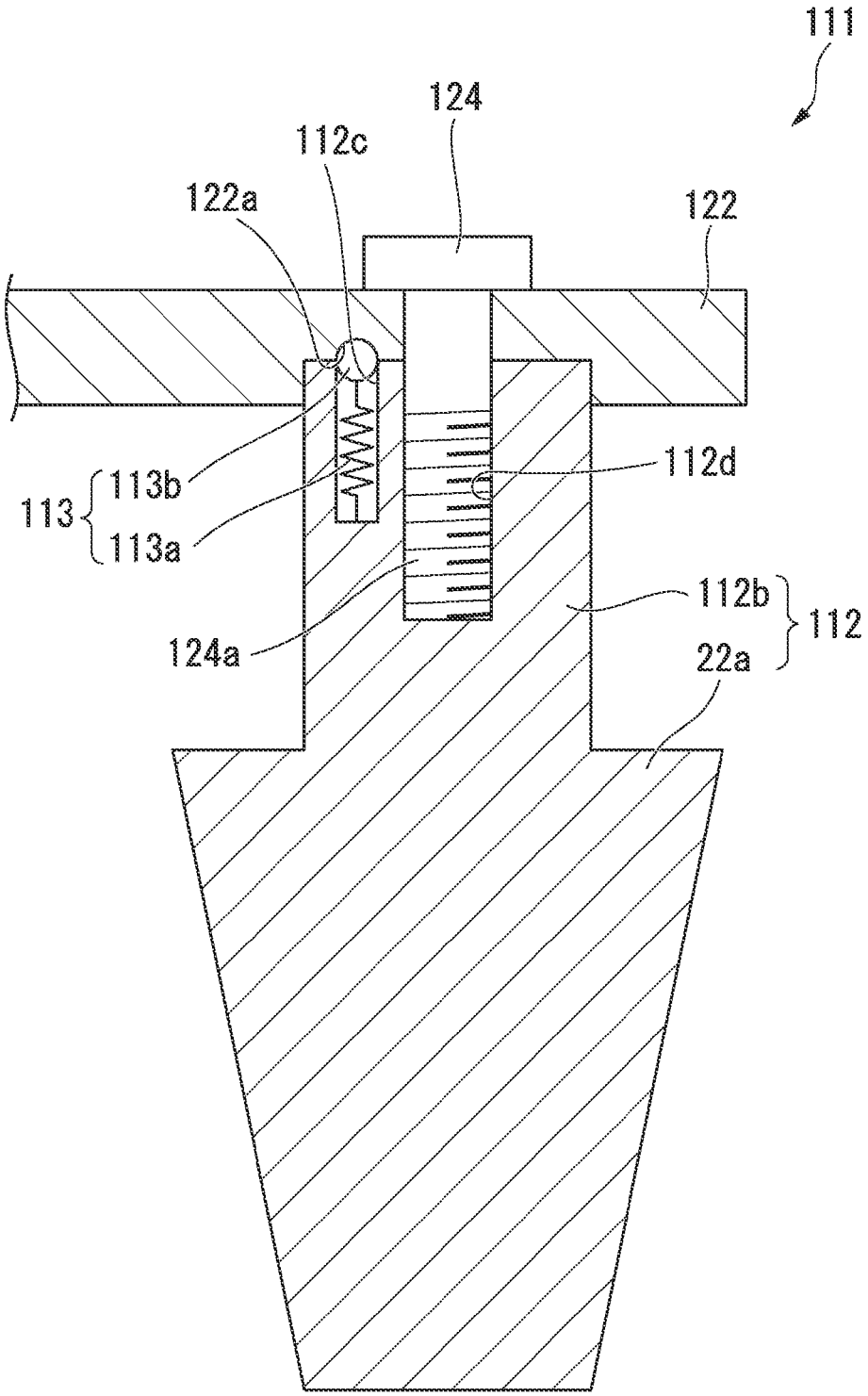
FIG. 9 is related to a centrifugal compressor according to a sixth embodiment of the present invention and is a diagram showing a connection position between a vane main body and a link member in an enlarged manner.

As shown in FIG. 9, the vane main body 112 has a torque limiter section 113 provided in a connection portion with a link member 122.

Here, in a shaft portion 112*b* (a rotary shaft) in the vane main body 112, a hole portion 112*c* is formed toward the inside in the radial direction with respect to the axis line O of the main shaft from the end face which faces the outside in the radial direction.

In addition, the link member 122 is a member having substantially the same shape as the link member 24 described above. In the link member 122, a concave portion 122*a* recessed toward the outside in the radial direction with respect to the axis line O of the main shaft at a position facing the hole portion 112*c* in the radial direction is formed.

Further, the shaft portion 112*b* and the link member 122 are connected by a pin 124 which is substantially the same as the pin 24*b* described above. In the pin 124, a male threaded portion 124*a* is formed on the tip side, and the male threaded portion 124*a* is screwed into a female threaded portion 112*d* formed in the shaft portion 112*b*. In addition, the pin 124 and the shaft portion 112*b* can relatively rotate with respect to the link member 122 with the radial direction with respect to the axis line O of the main shaft as an axis of rotation.

The torque limiter section 113 has a coil spring 113*a* provided in the hole portion 112*c* so as to extend in the radial direction from a bottom portion, and a ball member 113*b* mounted on the tip of the coil spring 113*a* and disposed over an area between the link member 122 and the concave portion 122*a*. In this embodiment, the torque limiter section 113 is a so-called ball plunger. Then, the ball member 113*b* is biased to the concave portion 122*a* of the link member 122 by the coil spring 113*a*.

According to the centrifugal compressor 111 of this embodiment, the torque limiter section 113 is adopted, whereby at the time of the normal operation of the drive ring 23 and the link member 122, the ball member 113*b* is disposed over an area between the link member 122 and the concave portion 122*a* and biased to the concave portion 122*a*, and therefore, the relative rotation of the shaft portion 112*b* and the link member 122 is restricted.

Here, in a case where one vane main body 112 does not rotate due to some cause, the link member 122 connected to the vane main body 112 does not operate, and thus the drive ring 23 does not operate.

For this reason, all of the vane main bodies 112 do not operate, and thus the flow rate adjustment of the fluid F which flows in the inflow flow path becomes impossible. At this time, torque acting on a connection portion between the shaft portion 112*b* of the vane main body 112 and the link member becomes larger, as compared to that at the time of the normal operation.

Here, in this embodiment, in a case where torque exceeds a threshold value set in advance, the ball member 113*b* of the torque limiter section 113 is pushed so as to be accommodated in the hole portion 112*c* against a biasing force of the coil spring 113*a*. In this way, if the torque exceeds the threshold value, relative rotation becomes possible between the shaft portion 112*b* and the link member 122.

Therefore, due to the relative rotation of the shaft portion 112*b* and the link member 122, even in a state where one vane main body 112 does not operate, it is possible to operate only the link member 122 to which the vane main body 112 is connected, and thus it becomes possible to operate other vane main bodies 112 by operating the drive ring 23. Accordingly, a flow rate adjustment function is not completely lost, thereby leading to improvement in reliability and usability.

In addition, the torque limiter section 113 of this embodiment is not limited to the ball plunger, and for example, a structure is also acceptable in which a friction member is provided between the shaft portion 112*b* and the link member 122 and, in a case where torque acting on the vane main body 112 exceeds a certain value, the shaft portion 112*b* and the link member 122 relatively rotate against a frictional force occurring in the friction member. Further, it is also possible to apply various known torque limiters.

The embodiments of the present invention have been described above in detail. However, some design changes are also possible within a scope which does not depart from the technical idea of the present invention.

In each of the embodiments described above, the electric motor 26 and the transmission arm 28 (58, 83, or 103) are used in the drive mechanism 25 (55, 82, or 102). However, it is also possible to apply a rotational force to the drive ring 23 by, for example, a hydraulic cylinder or the like.

Figure 10:
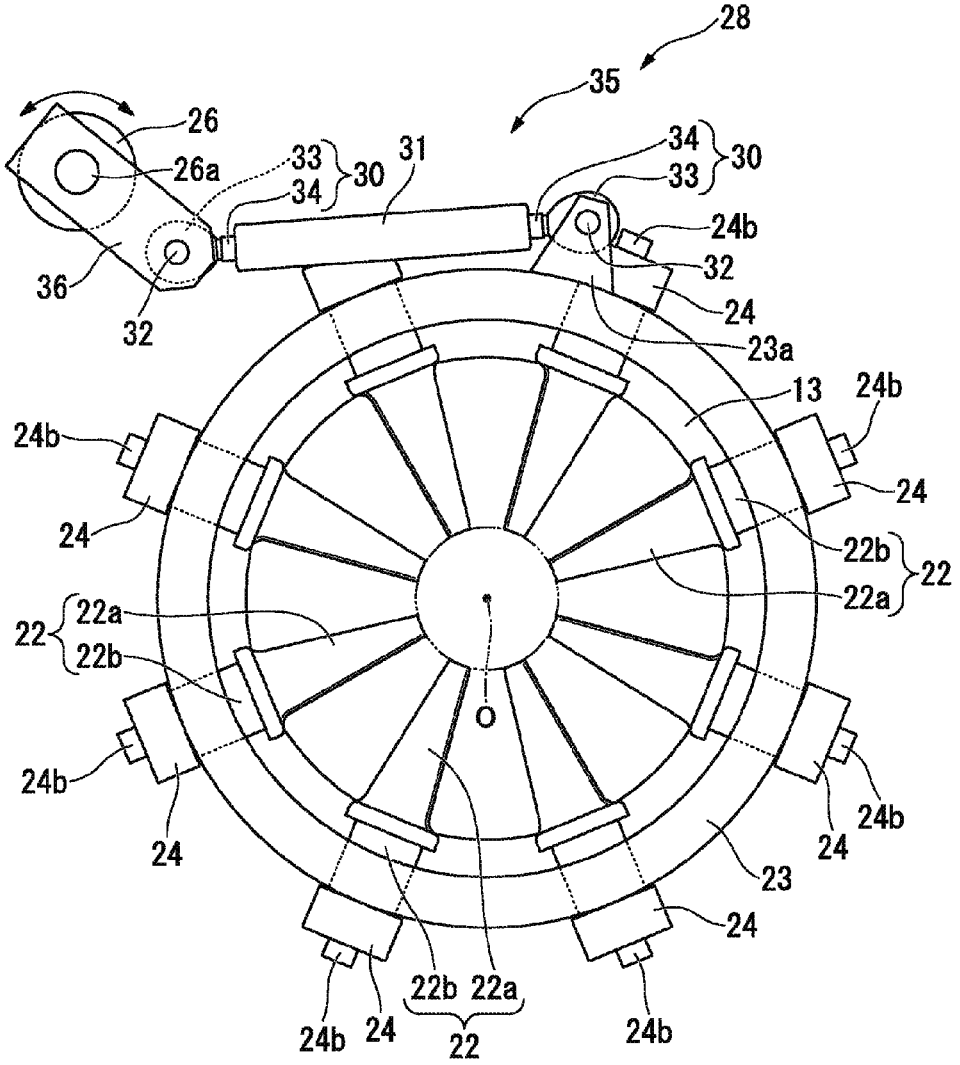
FIG. 10 is related to a centrifugal compressor according to a modified example of the first embodiment to the sixth embodiment of the present invention and is a diagram when a drive mechanism is viewed from the direction of an axis line.

Further, with respect to the transmission arm 28 (58, 83, or 103), for example, as shown in FIG. 10, a dedicated part may be used according to the type of a centrifugal compressor. Here, the length dimension of the transmission arm 28 depends on the outer diameter of the drive ring 23, and it is preferable that the ratio of the length dimension of the transmission arm 28 to the outer diameter of the drive ring 23 is in a range of 0.3 to 0.7.

Then, in this manner, in a case where a dedicated part is used for the transmission arm 28, it is not necessary to assemble the transmission arm 28, and therefore, the time required for assembly is shortened. Further, length adjustment required for the transmission arm 28 also becomes unnecessary, thereby leading to improvement in workability.

INDUSTRIAL APPLICABILITY

According to the centrifugal compressors described above, a rotational force is directly applied to the annular member by the drive mechanism, whereby it becomes possible to reduce the cost and accurately adjust the flow rate. In addition, a reduction in the size of the entire centrifugal compressor and efficiency improvement also become possible.

REFERENCE SIGNS LIST

1: centrifugal compressor
2: main shaft
3: main electric motor
3*a*: main output shaft
5: gear mechanism
6, 7: bearing
8: suction port
9: discharge port
10: impeller (bladed wheel)
10A: first stage impeller
10B: second stage impeller
11: vane device
12: casing
13: inner casing
15: main shaft gear
16: output shaft gear
17: disk
18: blade
20: return vane
22: vane main body
22*a*: blade portion
22*b*: shaft portion (rotary shaft)
23: drive ring
23*a*: projection portion
24: link member
24*a*, 24*b*: pin
25: drive mechanism
26: electric motor
26*a*: output shaft
28: transmission arm
30: universal joint
31: connecting rod-shaped portion
31*a*: female threaded portion (second threaded portion)
32: pin
33: spherical bearing
34: rod-shaped portion
34*a*: male threaded portion (first threaded portion)
35: driving link bar
36: driving lever
S1: compression flow path
S2: flow path
S2*a*: first stage diffuser flow path
S2*b*: return flow path
S2*c*: suction flow path
S2*d*: second stage diffuser flow path
S3: inflow flow path
F: fluid
O: axis line
51: centrifugal compressor
55: drive mechanism
58: transmission arm
60: projection portion
65: driving link bar
71: connecting rod-shaped portion
72: rectangular portion
73: bent portion
73*a*: through-hole
75: universal joint
76: rod-shaped portion
76*a*: female threaded portion (first threaded portion)
77: bolt (second threaded portion)
81: centrifugal compressor
82: drive mechanism
83: transmission arm
84: driving link member
85: connection portion
91: centrifugal compressor
93: torque detection section
94: control section
101: centrifugal compressor
102: drive mechanism
103: transmission arm
104: damping member

105: driving link member
105*a*: rectangular portion
105*b*: bent portion
104A: damping member
105A: driving link member
106A: flange portion
107A: O-ring
108A: bolt
111: centrifugal compressor
112: vane main body
112*b*: shaft portion (rotary shaft)
112*c*: hole portion
112*d*: female threaded portion
113: torque limiter section
113*a*: coil spring
113*b*: ball member
122: link member
122*a*: concave portion
124: pin
124*a*: male threaded portion

The invention claimed is:

1. A centrifugal compressor comprising:
a main shaft which rotates around an axis line;
a bladed wheel mounted on the main shaft; and
a vane device which adjusts a flow rate of a fluid in an inflow flow path to the bladed wheel, wherein
the vane device comprises:
a plurality of vane main bodies provided at intervals in a circumferential direction with respect to the axis line of the main shaft in the inflow flow path and each including a rotary shaft extending in a radial direction with respect to the axis line of the main shaft, wherein a mounting angle of the plurality of vane main bodies is changed by rotating the rotary shaft;
a plurality of links, which are rotated along with respective rotary shafts, and which have a block shape, wherein a first end of each the plurality of links is connected to the respective rotary shafts;
an annular member which is formed with an annular shape centered on the axis line and is moved in a moving direction along a rotation locus of the links, wherein the moving direction is both a axial direction and the circumferential direction, the rotation locus is generated by rotating with the vane main bodies, and the annular member is connected to a second end of each of the plurality of links; and
a drive mechanism which is connected to the annular member and transmits a force in a tangential direction to the annular member,
the drive mechanism comprises:
an output shaft which is rotationally driven; and
a transmission arm transmitting a rotational force from the output shaft to the annular member as a force in the tangential direction, wherein the a first end of the transmission arm is connected to the output shaft, and a second end of the transmission arm is connected to the annular member,
the transmission arm comprises:
a driving lever which is fixed to the output shaft, extends in a radial direction of the output shaft, and rotates along with the output shaft; and
a driving link bar, wherein a first end of the driving link bar is connected to the driving lever, and a second end of the driving link bar is connected to the annular member,
the driving link bar is provided with:
a connecting rod-shaped portion, having ends, extending along the circumferential direction with respect to the axis line of the main shaft; and
first and second universal joints provided at ends of the connecting rod-shaped portion, and
a first end of the connecting rod-shaped portion is connected to the driving lever via the first universal joint, and a second end of the connecting rod-shaped portion is connected to the annular member via the second universal joint, and
each of the vane main bodies comprises a torque limiter which allows respective rotary shafts to perform relative rotation between the rotary shafts and respective links in a case where torque acting on the vane main body exceeds a threshold value set in advance.

2. The centrifugal compressor according to claim 1, wherein the universal joints comprise:
two spherical bearings which are connected to the driving lever and the annular member; and
rod-shaped portions extending toward the connecting rod-shaped portion from the respective spherical bearings, thereby coming into contact with the connecting rod-shaped portion, and having a first threaded portion provided in a portion which is brought into contact with the connecting rod-shaped portion, and
the connecting rod-shaped portion is provided with a second threaded portion which is screwed with the first threaded portion.

3. The centrifugal compressor according to claim 1, further comprising:
a torque detector which detects a torque of an electric motor; and
a control section which reversely rotates the output shaft of the electric motor in a case where a detected value in the torque detector exceeds a threshold value set in advance.

4. A centrifugal compressor, comprising:
a main shaft which rotates around an axis line;
a bladed wheel mounted on the main shaft; and
a vane device which adjusts a flow rate of a fluid in an inflow flow path to the bladed wheel, wherein
the vane device comprises:
a plurality of vane main bodies provided at intervals in a circumferential direction with respect to the axis line of the main shaft in the inflow flow path and each including a rotary shaft extending in a radial direction with respect to the axis line of the main shaft, wherein a mounting angle of the plurality of vane main bodies is changed by rotating the rotary shaft;
a plurality of links, which are rotated along with respective rotary shafts, and which have a block shape, wherein a first end of each the plurality of links is connected to respective rotary shafts;
an annular member which is firmed with an annular shape centered on the axis line and is moved in a moving direction along a rotation locus of the links, wherein the moving direction is both a axial direction and the circumferential direction, the rotation locus is generated by rotating with the vane main bodies, and the annular member is connected to a second end of each of the plurality of links; and
a drive mechanism which is connected to the annular member and transmits a force in a tangential direction to the annular member, the drive mechanism comprises:

an output shaft which is rotationally driven; and a transmission arm transmitting a rotational force from the output shaft to the annular member as a force in the tangential direction, wherein the a first end of the transmission arm is connected to the output shaft, and a second end of the transmission arm is connected to the annular member, the transmission arm comprises:

a driving lever which is fixed to the output shaft, extends in a radial direction of the output shaft, and rotates along with the output shaft; and a driving link structure, wherein a first end of the driving link structure is connected to the driving lever, and a second end of the driving link structure is connected to the annular member, the driving link structure is provided with:

a connection portion extending in a direction away from the annular member; and first and second universal joints provided at the connection portion so as to be spaced apart from each other in at least one of the axial direction and a radial direction with respect to the axis line of the main shaft, a first end of the driving link structure is connected to the driving lever via the first universal joint on one side, and a second end of the driving link structure is connected to the annular member via the second universal joint on the other side, each of the vane main bodies comprises a torque limiter which allows respective rotary shafts to perform relative rotation between the rotary shafts and respective links in a case where torque acting on the vane main body exceeds a threshold value set in advance.

5. A centrifugal compressor comprising:

a main shaft which rotates around an axis line;

a bladed wheel mounted on the main shaft; and a vane device which adjusts a flow rate of a fluid in an inflow flow path to the bladed wheel, wherein the vane device comprises:

a plurality of vane main bodies provided at intervals in a circumferential direction with respect to the axis line of the main shaft in the inflow flow path and each including a rotary shaft extending in a radial direction with respect to the axis line of the main shaft, wherein a mounting angle of the plurality of vane main bodies is changed by rotating the rotary shaft;

a plurality of links, which are rotated along with respective rotary shafts, and which have a block shape, wherein a first end of each the plurality of links is connected to respective rotary shafts;

an annular member which is formed with an annular shape centered on the axis line and is moved in a moving direction along a rotation locus of the links, wherein the moving direction is both a axial direction and the circumferential direction, the rotation locus is generated by rotating with the vane main bodies, and the annular member is connected to a second end of each of the plurality of links; and a drive mechanism which is connected to the annular member and transmits a force in a tangential direction to the annular member, the drive mechanism comprises:

an output shaft which is rotationally driven; and a transmission arm transmitting a rotational force from the output shaft to the annular member as a force in the tangential direction, wherein the a first end of the transmission arm is connected to the output shaft, and a second end of the transmission arm is connected to the annular member, the transmission arm comprises:

a driving lever which is fixed to the output shaft, extends in a radial direction of the output shaft, and rotates along with the output shaft; and a driving link structure, wherein a first end of the driving link structure is connected to the driving lever, and a second end of the driving link structure is connected to the annular member, the driving link structure is provided with:

a damper which is damping a force acting on the driving link structure, and is provided between the first end of the driving link structure and the second end of the driving link structure; and first and second universal joints provided at the damper, and a first end of the driving link is connected to the driving lever via the first universal joint on one side, and a second end of the driving link is connected to the annular member via the second universal joint on the other side, and each of the vane main bodies comprises a torque limiter which allows respective rotary shafts to perform relative rotation between the rotary shafts and respective links in a case where torque acting on the vane main body exceeds a threshold value set in advance.

* * * * *